US009415484B1

(12) United States Patent
Mor

(10) Patent No.: US 9,415,484 B1
(45) Date of Patent: Aug. 16, 2016

(54) TECHNOLOGIES FOR HAND SANDING

(71) Applicant: Yadin Mor, Hellertown, PA (US)

(72) Inventor: Yadin Mor, Hellertown, PA (US)

( * ) Notice: Subject to any disclaimer, the term of this patent is extended or adjusted under 35 U.S.C. 154(b) by 71 days.

(21) Appl. No.: 14/633,727

(22) Filed: Feb. 27, 2015

Related U.S. Application Data

(63) Continuation of application No. 13/947,651, filed on Jul. 22, 2013, now Pat. No. 8,968,057.

(60) Provisional application No. 61/741,642, filed on Jul. 25, 2012.

(51) Int. Cl.
*B24D 15/00* (2006.01)
*B24D 15/02* (2006.01)

(52) U.S. Cl.
CPC ..... *B24D 15/02* (2013.01)

(58) Field of Classification Search
CPC ..... B24D 15/02; B24D 15/04
USPC ..... 451/344, 463, 495, 523, 524, 512; 269/266, 902
See application file for complete search history.

(56) References Cited

U.S. PATENT DOCUMENTS

| | | | | | |
|---|---|---|---|---|---|
| 408,433 | A | | 8/1889 | Prevost | |
| 470,794 | A | * | 3/1892 | Shempp | B24D 15/04 451/495 |
| 567,905 | A | * | 9/1896 | Locke | B24D 15/04 144/38 |
| 753,251 | A | * | 3/1904 | Ekvall | B24D 15/04 137/561 R |
| 1,062,214 | A | * | 5/1913 | Bergman | B24D 15/04 451/495 |
| 1,165,452 | A | * | 12/1915 | Rudolph | B24D 15/04 30/478 |
| 1,570,177 | A | * | 1/1926 | Pointer | B24D 15/00 15/231 |
| 2,214,515 | A | | 9/1940 | Vanderveer | |
| 2,282,043 | A | | 5/1942 | Ekstrom | |
| 2,438,977 | A | | 4/1948 | Rosemeyer | |
| 3,497,930 | A | | 3/1970 | O'Connor | |
| 3,813,830 | A | | 6/1974 | Hodge | |
| 3,998,012 | A | | 12/1976 | Ness | |
| 4,206,574 | A | | 6/1980 | Dotsko | |
| 5,050,308 | A | | 9/1991 | Walsh | |
| 5,140,784 | A | * | 8/1992 | Walsh | B24D 15/00 451/495 |
| 5,203,123 | A | | 4/1993 | Travis | |
| 5,203,885 | A | | 4/1993 | Pastre et al. | |

(Continued)

FOREIGN PATENT DOCUMENTS

| | | |
|---|---|---|
| GB | 2256383 | 12/1992 |
| GB | 2398259 | 8/2004 |
| WO | WO02055267 | 7/2002 |

*Primary Examiner* — Joseph J Hail
*Assistant Examiner* — Henry Hong
(74) *Attorney, Agent, or Firm* — Goldstein Law Offices, P.C.

(57) ABSTRACT

A hand sanding apparatus plate housing is provided. The housing includes a U-shaped top portion defined via a pair of opposing end members and a pair of opposing sidewalls spanning between the members along a sanding direction. The members having a pair of top surfaces extending along the direction and spanning between the sidewalls to provide for hand placement support along the direction. The members and the sidewalls defining a top portion interior space sized for adjacent flat plate housing. The members and the sidewalls defining an upper opening therebetween, the opening providing access to the space. The opening sized for partial plate access to enable manual plate position adjustment through the opening away from the opening to stagger the plates. The members configured for partial plate overlay along the direction between the sidewalls to limit plate movement at least perpendicular to the direction past the surfaces.

7 Claims, 10 Drawing Sheets

(56) References Cited

U.S. PATENT DOCUMENTS

| | | | | | |
|---|---|---|---|---|---|
| 5,588,904 | A | | 12/1996 | Allport | |
| 5,662,515 | A | | 9/1997 | Evensen | |
| 5,662,519 | A | | 9/1997 | Arnold | |
| 5,700,187 | A | * | 12/1997 | Balbi | B24D 15/04 451/495 |
| 5,759,090 | A | | 6/1998 | Kawate et al. | |
| 6,283,842 | B1 | * | 9/2001 | Collins | B24D 15/04 451/495 |
| 6,439,983 | B1 | | 8/2002 | McCoy et al. | |
| 6,503,612 | B1 | | 1/2003 | Copeland | |
| 8,057,286 | B2 | | 11/2011 | Walsh | |
| 2007/0173186 | A1 | | 7/2007 | Lin | |
| 2009/0221212 | A1 | | 9/2009 | Palushaj | |
| 2011/0291342 | A1 | | 12/2011 | Gindy et al. | |

* cited by examiner

TECHNOLOGIES FOR HAND SANDING

CROSS-REFERENCE TO RELATED APPLICATIONS

The present application is a continuation of U.S. Non-Provisional patent application Ser. No. 13/947,651, filed on Jul. 22, 2013, which claims priority from U.S. Provisional Patent Application Ser. No. 61/741,642, filed on Jul. 25, 2012, which is herein fully incorporated by reference for all purposes.

TECHNICAL FIELD

Generally, the present disclosure relates to hand sanding. More particularly, the present disclosure relates to hand sanding apparatuses.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned.

A typical hand sanding apparatus is a tool used for hand sanding a surface. One example of such surface is a profiled surface, such as a contoured molding surface. Often, such apparatus can be inadequate for hand sanding the profiled surface due to varying contouring curvature of the surface. Also, such apparatus can be inadequate for hand sanding the profiled surface due to poor ergonomics of such apparatus. Further, such apparatus can be structured such that a user is unable to hand sand the profiled surface in one movement, while applying pressure in a relatively uniform manner across the profiled surface. Such drawbacks become more pronounced when the user attempts to operate such apparatus for consecutively hand sanding a plurality of such profiled surfaces and/or hand sand the same profile surface several times, such as before, during, and/or after paint application.

While certain aspects of conventional technologies have been discussed to facilitate the present disclosure, no technical aspects are disclaimed. The claims may encompass at least one of the conventional technical aspects discussed herein.

BRIEF SUMMARY

The present disclosure addresses at least one of the above. However, the present disclosure may prove useful in addressing other problems and/or deficiencies in a number of technical areas. Therefore, the claims, as recited below, should not necessarily be construed as limited to addressing any of the particular problems and/or deficiencies discussed herein.

According to an example embodiment of the present disclosure a hand sanding apparatus plate housing is provided. The housing includes a U-shaped top portion defined via a pair of opposing end members and a pair of opposing sidewalls spanning between the members along a sanding direction. The members having a pair of top surfaces extending along the direction and spanning between the sidewalls to provide for hand placement support along the direction. The members and the sidewalls defining a top portion interior space sized for adjacent flat plate housing. The members and the sidewalls defining an upper opening therebetween. The opening providing access to the space. The opening sized for partial plate access to enable manual plate position adjustment through the opening away from the opening. The members configured for partial plate overlay along the direction between the sidewalls to limit plate movement at least perpendicular to the direction past the surfaces.

According to another example embodiment of the present disclosure a hand sanding apparatus is provided. The apparatus includes a unitary plate housing having a U-shaped top portion defined via a pair of opposing end members and a pair of opposing sidewalls spanning between the members along a sanding direction. The members having a pair of top surfaces extending along the direction and spanning between the sidewalls. The surfaces are outwardly arcuate along the direction between the sidewalls. The members and the sidewalls defining an upper opening therebetween. The housing having a pair of opposing T-shaped members. Each of the T-shaped members defined via a pair of arms extending from a leg. The legs extending from the end members such that the arms face each other. The surfaces are continuous with the legs. The housing having a pair of opposing side members spanning between the arms along the direction. The side members and the T-shaped members defining a lower opening therebetween. The lower opening providing access to the upper opening. The lower opening greater in area than the upper opening. One of the side members, the portion, and the T-members defining a recessed opening extending along the direction. The upper opening avoids extending past the side opening along the direction on both sides of the side opening. Another one of the side members is continuous with the top portion via a recessed sidewall having a first shaft opening therethrough. The recessed sidewall opposing the side opening.

According to yet another example embodiment of the present disclosure a hand sanding apparatus is provided. The apparatus includes a unitary plate housing having a U-shaped top portion defined via a pair of opposing end members and a pair of opposing sidewalls spanning between the members along a sanding direction. The members having a pair of top surfaces extending along the direction and spanning between the sidewalls. The surfaces are outwardly arcuate along the direction between the sidewalls. The members and the sidewalls defining an opening therebetween. The housing having a U-shaped side portion defined via a pair of opposing end elements and a base spanning between the elements along the direction. The elements continuously extending from the end members. The elements recessed with respect to one of the sidewalls. The base continuously extends from another one of the sidewalls. The apparatus also includes a plurality of flat plates extending along the direction between the elements. The plates positioned adjacent to each other between the sidewalls. The opening providing partial access to the plates such that the plates can be manually pushed through the opening away from the opening. The members partially overlaying the plates along the direction between the sidewalls to limit movement of the plates at least perpendicularly to the direction past the surfaces. The apparatus further includes a shaft extending through the plates. The shaft having a lever coupled thereto. The shaft coupled to the base distal to the lever. The lever avoids extending extending past the one of the sidewalls when in locked position.

The present disclosure may be embodied in the form illustrated in the accompanying drawings. Attention is called to the fact, however, that the drawings are illustrative. Variations are contemplated as being part of the disclosure, limited only by the scope of the claims. The above and other features, aspects and advantages of the present disclosure will become better understood to one skilled in the art with reference to the following drawings, detailed description and appended claims.

BRIEF DESCRIPTION OF THE DRAWINGS

The accompanying drawings illustrate example embodiments of the present disclosure. Such drawings are not to be construed as necessarily limiting the present disclosure. Like numbers and/or similar numbering scheme can refer to like and/or similar elements throughout.

DETAILED DESCRIPTION OF THE PREFERRED EMBODIMENTS

Figure 1A:
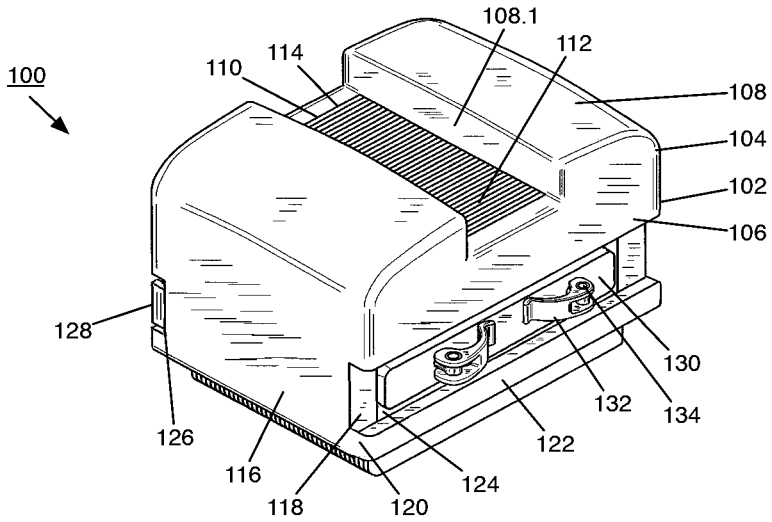
FIG. 1A shows a front perspective view of an example embodiment of a hand sanding apparatus according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments set forth herein. Rather, these example embodiments are provided so that the disclosure is thorough and complete, and fully conveys the concepts of the present disclosure to those skilled in the art. Also, features described with respect to certain example embodiments may be combined in and/or with various other example embodiments. Different aspects and/or elements of example embodiments, as disclosed herein, may be combined in a similar manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography, and so forth.

Any and/or all elements, as disclosed herein, can include, whether partially and/or fully, a solid, including a metal, a mineral, an amorphous material, a ceramic, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible and/or any other combinations thereof. Any and/or all elements, as disclosed herein, can be identical and/or different from each other in material, shape, size, color and/or any dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

FIG. 1A shows a front perspective view of an example embodiment of a hand sanding apparatus according to the present disclosure.

A hand sanding apparatus 100 includes a housing 102, which houses a plurality of plates 112 therein. Housing 102 includes a U-shaped top portion defined via a pair of opposing end members 104 and a pair of opposing sidewalls 106 spanning between members 104 along a sanding direction. Note that, in some example embodiments, the U-shaped portion can include C-shape or V-shape. Housing 102 can be at least partially unitary. The top portion can be at least partially unitary. Housing 102 can include plastic, rubber, and/or any other material for enhanced ergonomics, while tolerating dirt, sweat, fine sanding particles, and so forth.

Members 104 can be identical and/or different from each other in shape, area, volume, structure, orientation, size, dimensions, and so forth. Sidewalls 106 can be identical and/or different from each other in shape, area, volume, structure, orientation, size, dimension, and so forth. Members 104 and sidewalls 106 are continuous with each other. Members 104 have a pair of top surfaces 108 extending along the sanding direction. Such extension can be along at least partial longitudinal extension of members 104 along the sanding direction. Surfaces 108 are also spanning between sidewalls 106 to provide for hand placement support along said direction. Such spanning can be along at least partial lateral extension of members 104. Surfaces 108 can be identical and/or different from each other in shape, area, volume, structure, orientation, size, dimension, and so forth. Surfaces 108 are outwardly arcuate along the sanding direction between sidewalls 106. Such arching can be in an identical or different manner, whether in size, structure, orientation, shape, texture, and so forth. Such arching can include corner portions of members 104. Surfaces 108 can be outwardly arcuate diagonal to the sanding direction. Such arching can be in an identical or different manner, whether in size, structure, orientation, shape, texture, and so forth. Such arching can include corner portions of members 104.

Members 104 partially overlay plates 112 along the sanding direction and between sidewalls 106. Such overlay limits movement of plates 112 at least past surfaces 108 in a direction at least perpendicular to the sanding direction. Note that such overlay can also limit movement of plates 112 at most past surfaces 108 in the direction at least perpendicular to the sanding direction. Also, note that members 104 function as closed end tunnels for plates 112 such that plates 112 are limited in the movement along the sanding direction via members 104 and at least perpendicular to the sanding direction via roofs of members 104, which have surfaces 108 thereon. Further, note that members 104 have a pair of walls 108.1 spanning between sidewalls 106 and continuous with surfaces 108. Walls 108.1 can be identical and/or different from each other in shape, area, volume, structure, orientation, size, dimension, and so forth. Walls 108.1 can extend away from surfaces 108 up to sidewalls 106 or less. In other example embodiments, at least one of walls 108.1 is lacking and plates 112 rise up at most to surface 108 where the one of walls 108.1 is lacking.

Members 104 and sidewalls 106 define a top portion interior space 110, which is sized for housing plates 112 adjacent to each other as plates 112 extend in the sanding direction. Space 110 can be of any shape, whether sharp angled, curve angled, rounded, and so forth. For example, space 110 can be a polyhedron, an ellipsoid, a cuboid, and so forth. Members 104 and sidewalls 106 define an upper opening 114 therebetween. Opening 114 can be of any shape, such as a polygon, a parallelogram, a quadrilateral, a triangle, an ellipse, a star, a U-shape, a V-shape, a C-shape, and so forth. Opening 114 provides access to space 110. Opening 114 is sized to provide partial access to plates 112 such that a plurality of top surfaces of plates 112 is accessible, such as via sight, touch, and so forth. Such partial access enables manual positioning adjustment of plates 112 via the top surfaces of plates 112. For example, a user can apply force through opening 114 onto the top surfaces of plates 112 to move plates 112 vertically away from opening 114 for sanding of a profiled surface. Such force can include finger pushing the top surfaces.

Housing 102 further includes a pair of opposing T-shaped members 116. Each of T-shaped member 116 is defined via a pair of arms 120 extending from a leg 118. Arms 120 can be identical and/or different from each other in shape, area, volume, structure, orientation, size, dimension, and so forth. Legs 118 can be identical and/or different from each other in shape, area, volume, structure, orientation, size, dimension, and so forth. Legs 118 extend from members 104 such that arms 120 face each other. Surfaces 108 are continuous with exterior leading surfaces of legs 118, which can be identical to and/or different from each other in shape, area, volume, structure, orientation, size, dimension, and so forth. T-shaped members 116 can be at least partially unitary. T-shaped members 116 can be at least partially unitary with the U-shaped top portion. At least one of arms 120 avoids extending away from at least one of legs 118 past sidewalls 106.

Housing 102 also includes a pair of opposing side members 122 spanning between arms 120 along the sanding direction. Members 122 can be identical and/or different from each other in shape, area, volume, structure, orientation, size, dimension, and so forth. Members 122 and T-shaped members 116 define a lower opening therebetween. The lower opening is greater in area than opening 114. The lower opening provides access to space 110. The lower opening is sized such that plates 112 are output therethrough. T-shaped members 116 and members 122 can be at least partially unitary. Note that in other example embodiments, apparatus 100 can lack at least one member 122.

Within housing 102, one of side members 122, the U-shaped top portion, and T-members 116 define a recessed side opening 124 extending along the sanding direction. Opening 124 can be of any shape, size, orientation, direction, area, and so forth. Opening 114 is shorter in length along the sanding direction than opening 124. Opening 114 can extend along the sanding direction at most equivalent to opening 124. Opening 114 avoids extending past opening 124 along the sanding direction at least on one side of opening 124. Note however, that opening 114 can extend along the sanding direction longer than opening 124 and can extend past at least one side of opening 124. Note that in other example embodiments, opening 124 can be lacking. Also, in other example embodiments, opening 124 can be non-recessed, flush with one of sidewalls 106, protruding past one of sidewalls 106, and so forth. Opening 124 can be inclined towards and/or away from plates 112.

Another one of members 122 is continuous with the U-shaped top portion via a recessed sidewall 126, which has a shaft opening therethrough. Sidewall 126 opposes opening 124. Sidewall 126 can be identical to and/or different from opening 124 is size, shape, structure, area, orientation, and so forth. Opening 124 is more recessed inward than sidewall 126, although in other example embodiments such recessing can be reversed or identical. Note that in other example embodiments, sidewall 126 can be non-recessed, flush with one of sidewalls 106, protruding past one of sidewalls 106, and so forth. Sidewall 126 can be inclined towards and/or away from plates 112.

Plates 112 are adjacently positioned next to each other and are flat. Plates 112 can be non-flat as well. Plates 112 can be identical to and/or different from each other in shape, area, volume, structure, orientation, size, dimensions, abrasive properties, and so forth. Although plates 112 are rectangular, plates 112 can be of any shape, such as a polygon, a parallelogram, a quadrilateral, a triangle, an ellipse, a star, and so forth. Plates 112 can be positioned to at least partially fill space 110 between sidewalls 106.

Apparatus 100 also includes a flat spring 128, which is stationed along sidewall 126. Spring 128 has a slot having a wider portion and a narrower portion. Plate 128 has a tab for manual pulling. Note that in other example embodiments, apparatus 100 lacks spring 128. Note that in yet other example embodiments, apparatus 100 uses another locking technology, such as fastening, mating, interlocking, and so forth.

Apparatus 100 also includes a block 130, which is sized for at least partially conforming to opening 124 to at least partially fit thereinto. Block 130 contains an opening therethrough. The opening is sized for a shaft. Block 130 can be of any length, width, height, volume, area, shape, and so forth. Block 130 can be shaped as a plate, such as one of plates 112. Block 130 can be linear, curved, rigid, flexible, cushioned, energy absorbent, and so forth. Block 130 can have at least one valley and/or a hill. Block 130 can be flush and/or non-flush with at least one of legs 118. Block 130 can be flush and/or non-flush with one of sidewalls 106. Block 130 can be flush and/or non-flush with one of members 122. Note that in other example embodiments, apparatus 100 lacks block 130. Note that in some example embodiments, block 130 can function as one of plates 112.

Apparatus includes a shaft having a lever 132 coupled thereto via a pin 134. Shaft 132 can be of any type. Pin 134 can be of any type. Lever 132 can be of any type. In other example embodiments, lever 132 can be coupled to the shaft without pin 134. Block 130 is between lever 132 and plates 112. Lever 132 can pivot at least between a first position, such as for locking plates 112 in their respective vertical positions, and a second position, such as for unlocking plates 112 from their respective at least vertical positions. Lever 132 avoids extending past the one of sidewalls 106, above lever 132, when in locked position. However, note that in other example embodiments, lever 132 extends past the one of sidewalls 106, above lever 132, when in locked position. Also, note that in other example embodiments, plates 112 are locked without using lever 132, such as when lever 132 is lacking. Note that when more than one lever 132, pin 134, and the shaft is used, then levers 132, pins 134, and/or the shafts can be respectively identical and/or different from each other in shape, area, volume, structure, orientation, size, dimension, and so forth.

Note that housing 102 can have at least one bridge and/or at least one handle extending and/or spanning between members 104 over opening 114. Such bridge and/or handle can extend and/or span from surfaces 108 or below surfaces 108, yet above plates 112. Such bridge and/or handle can contact plates 112. Such bridge and/or handle can extend diagonally and/or along the sanding direction. Such bridge and/or handle can be linear, curvy, and so forth. Such bridge and/or handle can be of any type. Such handle can also be coupled to one of members 104 only. Such handle can also be coupled to at least one of sidewalls 106. Such handle can further be coupled to any portion of T-shaped members 116 and/or members 122 in any way.

Figure 1B:
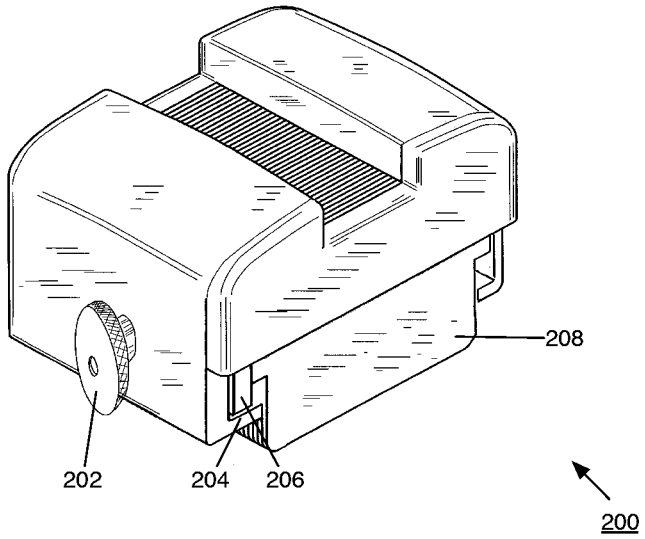
FIG. 1B shows a front perspective view of an example embodiment of a hand sanding apparatus according to the present disclosure.

FIG. 1B shows a front perspective view of an example embodiment of a hand sanding apparatus according to the present disclosure. Some concepts depicted in this figure are described above. Thus, same reference characters identify same or like components described above and any repetitive detailed description thereof will hereinafter be omitted or simplified in order to avoid complication.

A hand sanding apparatus 200 includes a knob 202, a pair of ledges 204, a clamping/pressure application member 206 and a plurality of plates 208. Knob 202 can rotate with respect to members 104. Knob 202 can be threaded. Knob 202 can be of any type. Knob 202 rotates in two opposing directions, such as clockwise and counterclockwise. Note that in other example embodiments, apparatus 200 lacks knob 202 and instead uses a button for similar functionality.

Member 206 is within space 110. Some examples of member 206 include a plate, a shaft, a rod, a block, and so forth. Member 206 is operably coupled to knob 202. Member 206 extends within space 110 between sidewalls 106 and can span between sidewalls 106. Member 206 can be of any shape, size, area, structure, orientation, and so forth. Member 206 contacts plates 112 in a direction different from the sanding direction.

Ledges 204 extend from legs 118 such that legs 118 and ledges 204 are L-shaped toward plates 112. Ledges 204 and ledges 118 can be an assembly and/or at least partially unitary. Ledges 204 can be identical to and/or different from each other in shape, area, volume, structure, orientation, size, dimensions, and so forth. Member 206 can vertically extend between one of ledges 204 and an interior surface of member 104 opposing surface 106.

Plates 208 are T-shaped, as defined via a pair of arms extending from a leg, which can be used for sanding, whether directly and/or indirectly. Plates 208 are adjacently positioned next to each other and are flat. Plates 208 can be non-flat as well. Plates 208 can be identical to and/or different from each other in shape, area, volume, structure, orientation, size, dimensions, abrasive properties, and so forth. The arms and/or the legs can be identical to and/or different from each other in shape, area, volume, structure, orientation, size, dimensions, and so forth. Plates 208 can be positioned to at least partially fill space 110 between sidewalls 106. Ledges 204 limit movement of plates 208 at least perpendicular to the sanding direction away from opening 114 such that ledges 204 and the arms of T-shaped plates are in contact with each other during such limitation.

In one example mode of operation, upon rotation of knob 202 in one direction, such as clockwise, member 206 applies pressure at least to the arms of plates 208 via tightening/clamping to fix plates 208 in their respective vertical positions, which can be vertically pre-adjusted via opening 114. Likewise, upon rotation of knob 202 in another direction, such as counterclockwise, within space 110, member 206 withdraws pressure from plates 112 via un-tightening/unclamping to unfix plates 112 from their respective vertical positions, such as for vertical plate position readjustment.

Figure 2A:
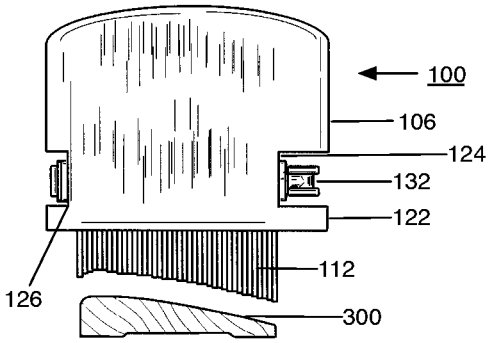
FIG. 2A shows a front side view of an example embodiment of a hand sanding apparatus before placement onto a profiled surface according to the present disclosure.

FIG. 2A shows a front side view of an example embodiment of a hand sanding apparatus before placement onto a profiled surface according to the present disclosure. Some concepts depicted in this figure are described above. Thus, same reference characters identify same or like components described above and any repetitive detailed description thereof will hereinafter be omitted or simplified in order to avoid complication.

Plates 112 protrude out of the lower opening of housing 102. Plates 112 are staggered, having different vertical positions to properly fit a profiled surface 300 for hand sanding via apparatus 100. Plates 112 are fixed in their respective positions via lever 132. Lever 132 is in locked position. Lever 132 avoids extending past the one of sidewalls 106, above lever 132. Lever 132 also avoids extending past arms 120 and members 122. Arms 120 avoid extending away from legs 118 past sidewalls 106. Members 122 avoid extending away or protruding past sidewalls 106. Spring 128 avoids extending away or protruding past another one of sidewalls 106, arms 120 and members 122. Note that opening 124 is more recessed inward than sidewall 126.

Figure 2B:
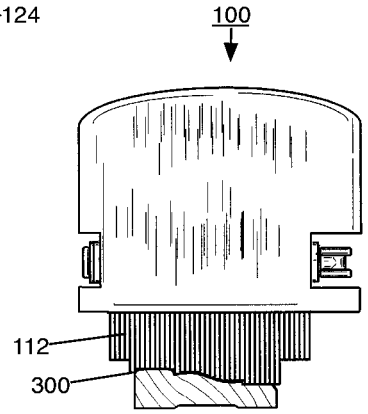
FIG. 2B shows a front side view of an example embodiment of a hand sanding apparatus when placed onto a profiled surface with some plates avoiding contact with the surface according to the present disclosure.

FIG. 2B shows a front side view of an example embodiment of a hand sanding apparatus when placed onto a profiled surface with some plates avoiding contact with the surface according to the present disclosure. Some concepts depicted in this figure are described above. Thus, same reference characters identify same or like components described above and any repetitive detailed description thereof will hereinafter be omitted or simplified in order to avoid complication.

Less than all of plates 112 are in sanding contact with surface 300. Note that such contact can be continuous and/or segmented in any manner.

Figure 2C:
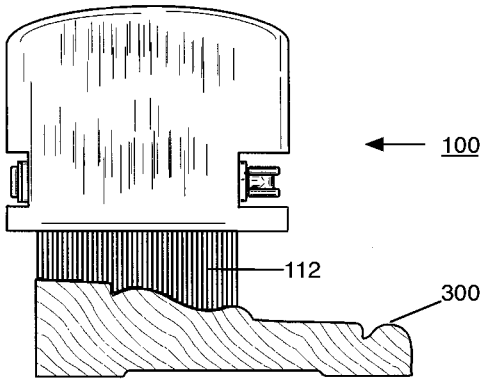
FIG. 2C shows a front side view of an example embodiment of a hand sanding apparatus when placed onto a profiled surface with all plates contacting the surface according to the present disclosure.

FIG. 2C shows a front side view of an example embodiment of a hand sanding apparatus when placed onto a profiled surface with all plates contacting the surface according to the present disclosure. Some concepts depicted in this figure are described above. Thus, same reference characters identify same or like components described above and any repetitive detailed description thereof will hereinafter be omitted or simplified in order to avoid complication.

All plates 112 are in sanding contact with surface 300. Plates 112 can be readily adjusted between any of positions in FIGS. 2A-2C and other vertical positions via operating lever 132, such as to an unlocking position, manually adjusting vertical positioning of plates 112 through opening 114, and then operating lever 132, such as to a locking position, to fix plates 112 in other vertical positions, such as when first positioning adjustment was not producing precise enough sanding results.

Figure 3A:
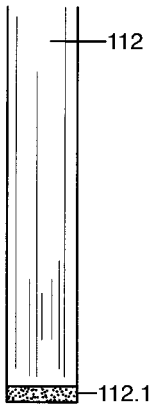
FIG. 3A shows a front side view of an example embodiment of a plate equipped with an abrasive piece according to the present disclosure.

FIG. 3A shows a front side view of an example embodiment of a plate equipped with an abrasive piece according to the present disclosure. Some concepts depicted in this figure are described above. Thus, same reference characters identify same or like components described above and any repetitive detailed description thereof will hereinafter be omitted or simplified in order to avoid complication.

At least one of plates 112 is equipped with an abrasive piece 112.1, which can be a strip at least partially extending along the at least one of plates 112. Note that a plurality of pieces 112.1, whether identical to and/or different from each other, can extend along the at least one of plates 112, such as via segmentation. Such equipping can be direct or indirect. For example, such equipping can be via an assembly, such as via fastening, mating, locking, and so forth. Alternatively, piece 112.1 can be at least partially unitary with at least one of plates 112, such as via manufacturing. Note that such equipping can account for at least one of dirt, fine particles, dust, liquids, varying temperature, sweat, and so forth. Also note that piece 112.1 can be for single use, multiple use, reuse, and so forth. When piece 112.1 becomes dull, then in some example embodiments, piece 112.1 can be removed and interchanged with another similar piece 112.1. Note that piece 112.1 can be serrated, such as serrated ceramic and/or serrated metal in any manner. Further, note that piece 112.1 can at least partially include a nail file configuration.

Figure 3B:
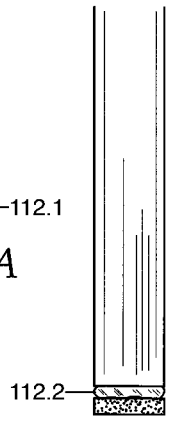
FIG. 3B shows a front side view of an example embodiment of a plate coupled to an abrasive piece via an adhesive according to the present disclosure.

FIG. 3B shows a front side view of an example embodiment of a plate coupled to an abrasive piece via an adhesive according to the present disclosure. Some concepts depicted in this figure are described above. Thus, same reference characters identify same or like components described above and any repetitive detailed description thereof will hereinafter be omitted or simplified in order to avoid complication.

At least one of plates 112 includes an adhesive 112.2, which adheres piece 112.2 to the at least one of plates 112. Adhesive 112.2 can be a strip at least partially extending along the at least one of plates 112. Note that a plurality of adhesives 112.2, whether identical to and/or different from each other, can extend along the at least one of plates 112, such as via segmentation. Such adhering can be direct or indirect. Adhesive 112.2 can be user applied or applied during manufacturing. Note that adhesive 112.2 can adhere sufficiently while accounting for at least one of dirt, fine particles, dust, liquids, varying temperature, sweat, and so forth. Adhesive 112.2. can include a gel, which can provide for cushioning.

Figure 3C:
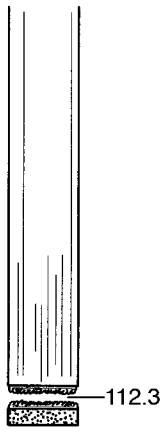
FIG. 3C shows a front side view of an example embodiment of a plate coupled to an abrasive piece via a hook-and-loop fastening technology according to the present disclosure.

FIG. 3C shows a front side view of an example embodiment of a plate coupled to an abrasive piece via a hook-and-loop fastening technology according to the present disclosure. Some concepts depicted in this figure are described above. Thus, same reference characters identify same or like components described above and any repetitive detailed description thereof will hereinafter be omitted or simplified in order to avoid complication.

At least one of plates 112 and piece 112.1 are coupled to each other via a hook-and-loop fastening technology 112.3 in any manner, whether the at least one of plates 112 includes a hook and piece 112.1 includes a loop or vice versa. Technology 112.3 can be silent. Technology 112.3 can be a strip at least partially extending along the at least one of plates 112. Note that a plurality of technologies 112.3, whether identical to and/or different from each other, can extend along the at least one of plates 112, such as via segmentation. Note that technology 112.3 can adhere sufficiently while accounting for at least one of dirt, fine particles, dust, liquids, varying temperature, sweat, and so forth.

Figure 3D:
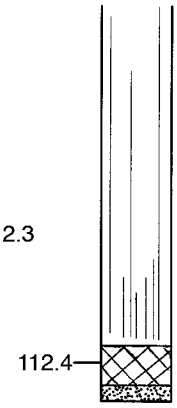
FIG. 3D shows a front side view of an example embodiment of a plate coupled to an abrasive piece via a foam piece according to the present disclosure.

FIG. 3D shows a front side view of an example embodiment of a plate coupled to an abrasive piece via a foam piece according to the present disclosure. Some concepts depicted in this figure are described above. Thus, same reference characters identify same or like components described above and any repetitive detailed description thereof will hereinafter be omitted or simplified in order to avoid complication.

At least one of plates 112 is equipped with a foam piece 112.4, which can be a strip at least partially extending along the at least one of plates 112. Note that a plurality of pieces 112.4 can extend along the at least one of plates 112, such as via segmentation. Such equipping can be direct or indirect. For example, such equipping can be via an assembly, such as via fastening, mating, locking, and so forth. Alternatively, piece 112.4 can be at least partially unitary with at least one of plates 112, such as via manufacturing. Note that such equipping can account for at least one of dirt, fine particles, dust, liquids, varying temperature, sweat, and so forth. Foam of piece 112.4 can be of any type, such as including polyurethane, rubber, and so forth. Note that piece 112.4 can include any type of cushioning material, such as foam, rubber, and so forth.

Piece 112.1 is coupled to piece 112.4. Such coupling can be via a strip at least partially extending along the at least one of plates 112. Note that a plurality of pieces 112.4 can extend along piece 112.1, such as via segmentation, or a plurality of pieces 112.1 can extend along piece 112.4, such as via segmentation. Such coupling can be direct or indirect. For example, such coupling can be via an assembly, such as via fastening, mating, locking, and so forth. Alternatively, piece 112.4 can be at least partially unitary with piece 112.1, such as via manufacturing. Note that such coupling can account for at least one of dirt, fine particles, dust, liquids, varying temperature, sweat, and so forth.

Note that any number plates 112 can be coupled to any abrasive piece 112.1 in any combinatory manner. For example, apparatus 100 can include at least four plates of plates 112 with at least four abrasive pieces 112.1 uniquely coupled thereto according to FIGS. 3A-3D.

Figure 4:
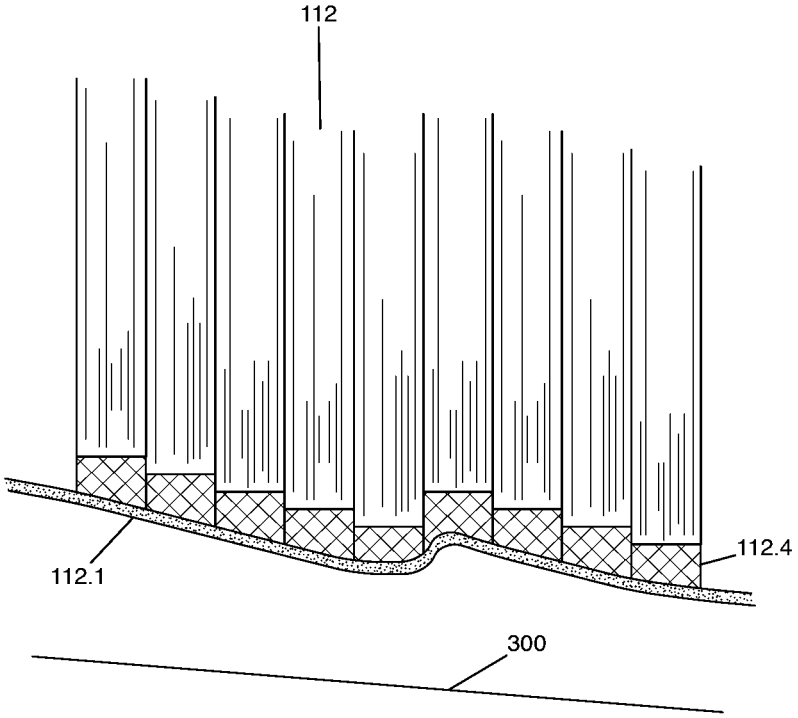
FIG. 4 shows a front side view of a plurality of adjacent plates uniquely coupled to a plurality of foam pieces contacting a sand paper surface for sanding according to the present disclosure.

FIG. 4 shows a front side view of a plurality of adjacent plates uniquely coupled to a plurality of foam pieces contacting a sand paper surface for sanding according to the present disclosure. Some concepts depicted in this figure are described above. Thus, same reference characters identify same or like components described above and any repetitive detailed description thereof will hereinafter be omitted or simplified in order to avoid complication.

Plates 112 are coupled to pieces 112.4. Pieces 112.4 are in contact with one piece 112.1 on one side of piece 112.1. On opposing side of piece 112.1, is an abrasive surface of piece 112.1, which comes in contact with surface 300 during hand sanding. Piece 112.1 can include sanding paper.

Figure 5A:
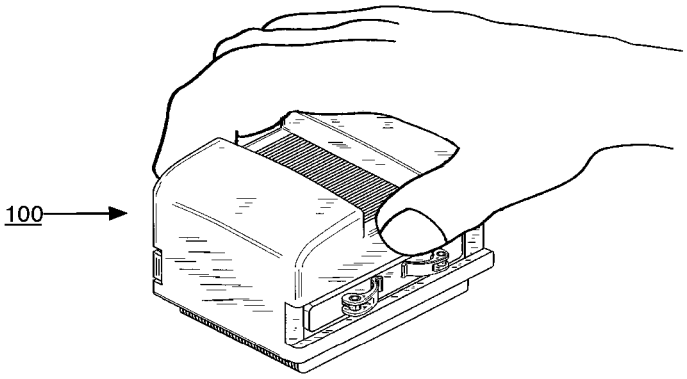
FIG. 5A shows a front perspective view of an example embodiment of a hand sanding apparatus in one example method of operation according to the present disclosure.

FIG. 5A shows a front perspective view of an example embodiment of a hand sanding apparatus in one example method of operation according to the present disclosure. Some concepts depicted in this figure are described above. Thus, same reference characters identify same or like components described above and any repetitive detailed description thereof will hereinafter be omitted or simplified in order to avoid complication.

Apparatus 100 is held such that a user's thumb rests on one of sidewalls 106 above opening 124 and at least one other finger, such as an index finger, a middle finger, a ring finger, and little finger, rests on another one of sidewalls 106. The user can then move apparatus 100 back and forth along the sanding direction for hand sanding.

Figure 5B:
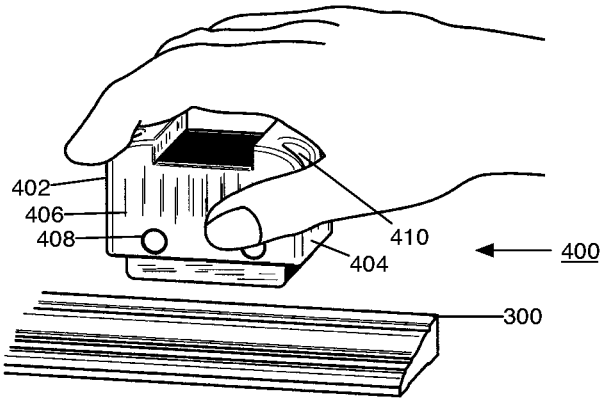
FIG. 5B shows a front perspective view of an example embodiment of a hand sanding apparatus in another example method of operation according to the present disclosure.

FIG. 5B shows a front perspective view of an example embodiment of a hand sanding apparatus in another example method of operation according to the present disclosure. Some concepts depicted in this figure are described above. Thus, same reference characters identify same or like components described above and any repetitive detailed description thereof will hereinafter be omitted or simplified in order to avoid complication.

Apparatus 400 includes a housing 402, which has a U-shaped top portion similar to housing 102. Housing 402 also includes a U-shaped side portion defined via a pair of opposing end elements 404, which function as leading walls, and a base 406 spanning between elements 404 along the sanding direction. Elements 404 extend at least perpendicular the sanding direction. Elements 404 continuously extend from members 104. Elements 404 are recessed with respect to one of sidewalls 106, which spans between members 104 and is above lever 132. Elements 404 can be identical and/or different from each other in shape, area, volume, structure, orientation, size, dimension, and so forth. Base 406 continuously extends from another one of sidewalls 106 thereby being opposing lever 132. Base 406 includes a pair of openings 408 sized for shaft coupling in order to fix plates 112 in their respective vertical positions for handing sanding surface 300. Note that in other example embodiments, base 406 can include one opening 408 or at least three openings 408 as well. Openings 408 can be identical and/or different from each other in shape, area, structure, orientation, size, dimension, and so forth. Openings 408 can be aligned or misaligned.

At least one of surfaces 108 includes at least one finger groove 410, which can be of any type and can include at least one ridge for enhanced gripping. A plurality of grooves 410 can be identical and/or different from each other in shape, area, volume, structure, orientation, size, dimension, and so forth. A plurality of ridges can be identical and/or different from each other in shape, area, volume, structure, orientation, size, dimension, and so forth. Note that at least one of sidewalls 106 can also include at least one groove 410. Also note that at least one of members 404 can contain at least one groove 410 thereon. Further note that base 406 can also contain at least one groove 410 thereon.

In one example mode of operation, apparatus 400 is held such that a user's thumb rests on base 406 and at least one of index finger and a middle finger rests within groove 410 on surface 108. The user can then move apparatus 400 back and forth along the sanding direction for hand sanding.

Figure 6A:
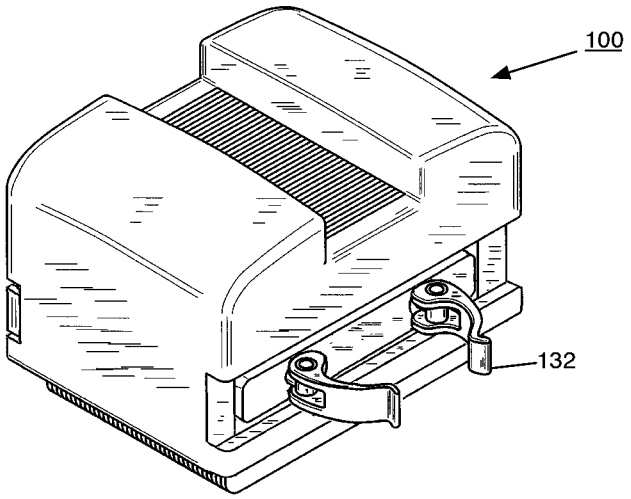
FIG. 6A shows a front perspective view of an example embodiment of a hand sanding apparatus with a pair of locking levers in an open position according to the present disclosure.

FIG. 6A shows a front perspective view of an example embodiment of a hand sanding apparatus with a pair of locking levers in an open position according to the present disclosure. Some concepts depicted in this figure are described above. Thus, same reference characters identify same or like components described above and any repetitive detailed description thereof will hereinafter be omitted or simplified in order to avoid complication.

Lever 132 is pivoted via pin 134 into an unlocking position in which plates 112 can be vertically adjusted via opening 114. Lever 132 extends past one of sidewalls 106 when in the unlocking position. However, in other example embodiments, lever 132 avoids extending past one of sidewalls 106 when in the unlocking position.

Figure 6B:
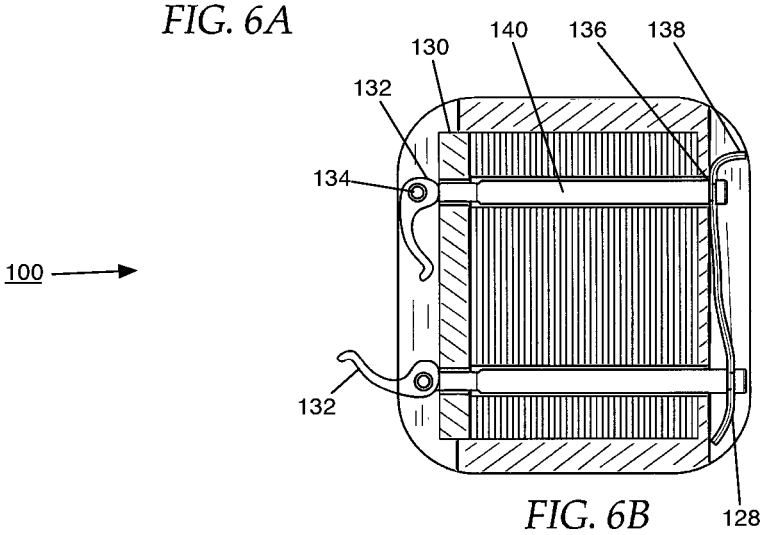
FIG. 6B shows an underside cross-sectional view of an example embodiment of a hand sanding apparatus with first lever in a locked position and a second lever in an unlocked position according to the present disclosure.

FIG. 6B shows an underside cross-sectional view of an example embodiment of a hand sanding apparatus with first lever in a locked position and a second lever in an unlocked position according to the present disclosure. Some concepts depicted in this figure are described above. Thus, same reference characters identify same or like components described above and any repetitive detailed description thereof will hereinafter be omitted or simplified in order to avoid complication.

Figure 10:
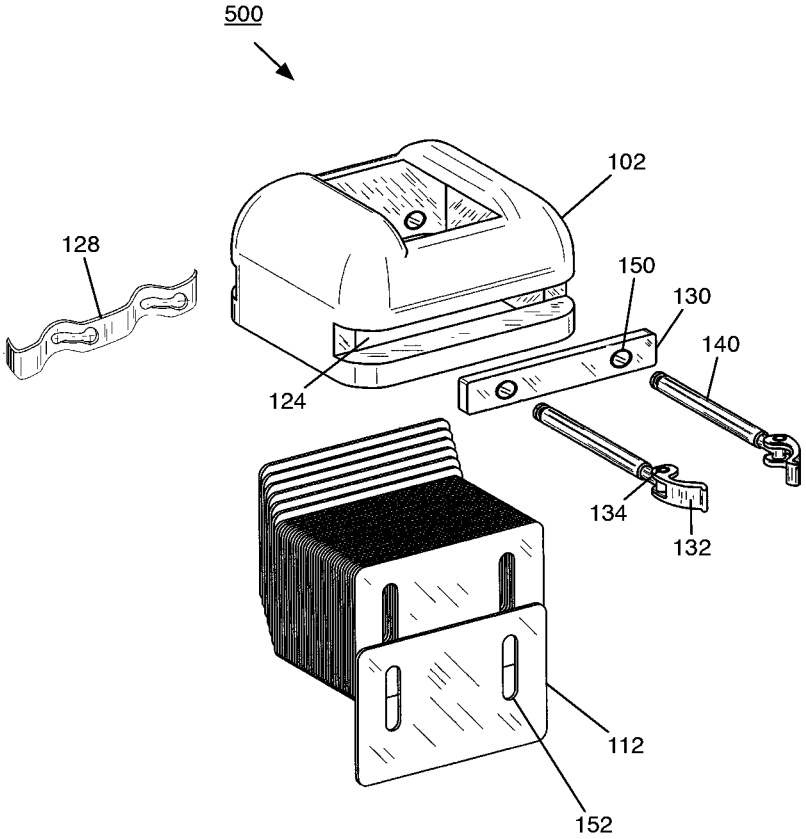
FIG. 10 shows a perspective view of an example embodiment of a set of components for use in manufacturing a hand sanding apparatus according to the present disclosure.

A shaft 140 extends through plates 112, through the elongated slot 152 therein (FIG. 10). Shaft 140 can be hollow, solid, and/or any combination thereof. When more than one shaft 140 is used, then shafts 140 can be identical and/or different from each other in shape, area, volume, structure, orientation, size, dimension, and so forth. Lever 132 is coupled to one end of shaft 140. Shaft 140 has a T-end 136 distal to lever 132.

Spring 128 has a tab 138 structured for user pulling. Spring 128 has at least one slot with the wider portion and the narrower portion. T-end 136 is input into the wider portion and then slid to the narrower portion, which prohibits T-end 136 from removal therefrom.

Levers 132 are shown. One of levers 132 is in locked position and another of levers 132 is in unlocked position. Levers 132 pivot about pins 134 between the positions. Lever 132, which avoids extending past one of sidewalls 106, is in locked position. Note that T-end 136 pulls the narrower portion of spring 128 closer to plates 112 for clamping/tightening. Therefore, in such position, plates 112 are fixed in their respective vertical positions on locked lever 132 side. Lever 132, which extends past one of sidewalls 106, is in unlocked position. Note that T-end 136 avoids pulling the narrower portion of spring 128 closer to plates 112 for clamping/tightening. Therefore, in such position, plates 112 are not fixed in their respective vertical positions on unlocked lever 132 side. Note that shaft 140 can be coupled to base 406 via openings 408 in a similar manner.

Figure 7:
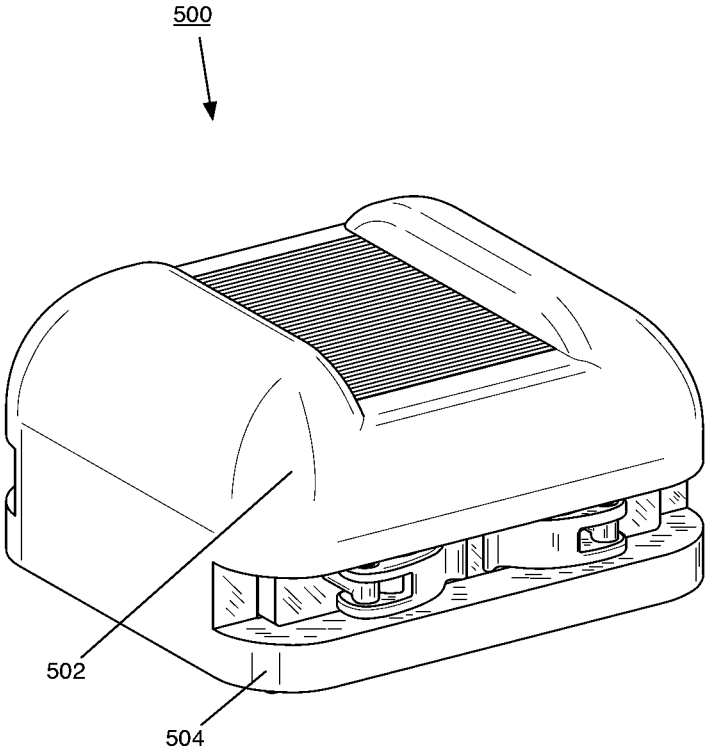
FIG. 7 shows a front perspective view of an example embodiment of a hand sanding apparatus according to the present disclosure.

FIG. 7 shows a front perspective view of an example embodiment of a hand sanding apparatus according to the present disclosure. Some concepts depicted in this figure are described above. Thus, same reference characters identify same or like components described above and any repetitive detailed description thereof will hereinafter be omitted or simplified in order to avoid complication.

Apparatus 500 includes at least one surface 108, which is outwardly arcuate in a direction 502, which is diagonal to the sanding direction. Such arching can be in an identical or different manner, whether in size, area, volume, structure, orientation, shape, texture, and so forth. Such arching can include corner portions of members 104. Also note that at least one of arms 120 is outwardly arcuate in a direction 504, which is diagonal to the sanding direction. Such arching can be in an identical or different manner, whether in size, structure, area, volume, orientation, shape, texture, and so forth. Direction 502 and direction 504 can be identical to and/or different from each other. Further note how house arching curvature of apparatus 500 appears like a computer mouse. Additionally note that block 130 fully conforms to opening 124.

Figure 8:
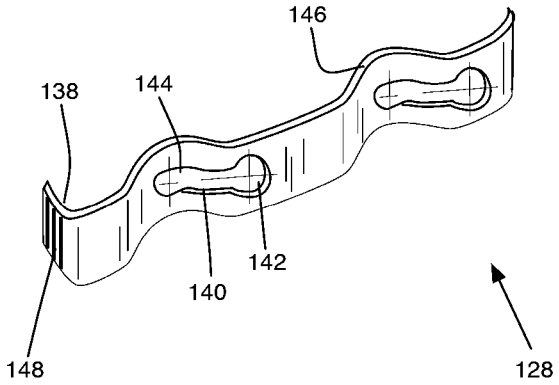
FIG. 8 shows a front perspective view of an example embodiment of a flat spring according to the present disclosure.

FIG. 8 shows a front perspective view of an example embodiment of a flat spring according to the present disclosure. Some concepts depicted in this figure are described above. Thus, same reference characters identify same or like components described above and any repetitive detailed description thereof will hereinafter be omitted or simplified in order to avoid complication.

Spring 128 has tab 138 structured for user pulling in the sanding direction. Tab 138 has at least one ridge 148 thereon. When more than one ridge 148 is used, then ridges 148 can be identical to and/or different from each other, whether in size, structure, area, orientation, shape, and so forth. Spring 128 has at least one slot 140 with a wider portion 142 and the narrower portion 144. When more than one slot 140 is used, then slots 140 can be identical to and/or different from each other, whether in size, structure, area, orientation, shape, and so forth. T-end 136 is input into wider portion 142 and then slid to narrower portion 144, which prohibits T-end 136 from removal therefrom. Spring 128 also has an outwardly projecting curve 146, which is bent inward closer to plates 112 when T-end 136 is clamped/tightened via lever 132 operated into the locking position.

Figure 9:
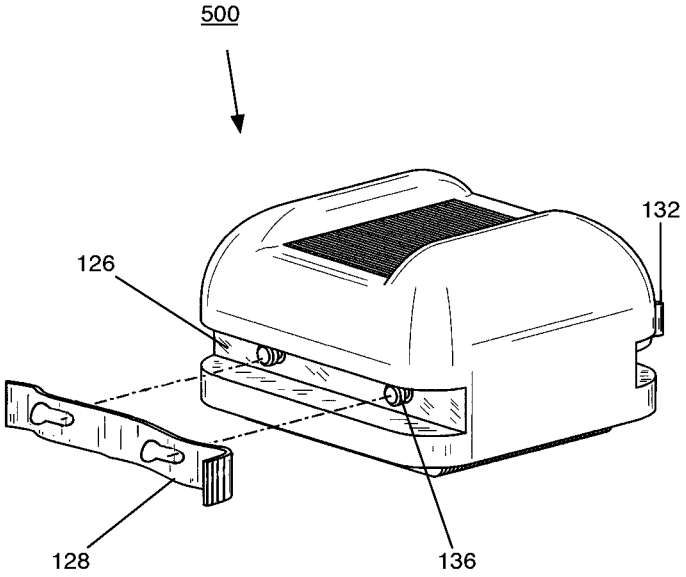
FIG. 9 shows a back perspective view of an example embodiment of a hand sanding apparatus being coupled to a flat spring according to the present disclosure.

FIG. 9 shows a back perspective view of an example embodiment of a hand sanding apparatus being coupled to a flat spring according to the present disclosure. Some concepts depicted in this figure are described above. Thus, same reference characters identify same or like components described above and any repetitive detailed description thereof will hereinafter be omitted or simplified in order to avoid complication.

Sidewall 126 has at least one opening through which T-end 136 of shaft 140 projects out of. Spring 128 is placed adjacent to sidewall 126 such that T-end 126 is input into wider portion 142 of slot 140. Spring 128 is then moved along the sanding direction such that T-end 136 is slid into narrower portion 144, which prohibits T-end 136 from being removed therefrom. Note that lever 132 is extending past one of sidewalls 106 and is in the unlocked position. When lever 132 is operated into the locked position, such as in FIG. 6B, T-end 136 pulls curve 146 toward plates 112 thereby fixing plates 112 in their respective vertical positions at least for the operated lever 132.

FIG. 10 shows a perspective view of an example embodiment of a set of components for use in manufacturing a hand sanding apparatus according to the present disclosure. Some concepts depicted in this figure are described above. Thus, same reference characters identify same or like components described above and any repetitive detailed description thereof will hereinafter be omitted or simplified in order to avoid complication.

A set for manufacturing apparatus 500 is disclosed. The set comprises housing 102, plates 112, shafts 140, levers 132, pins 134, block 130 and spring 128. Note that plates 112 have at least one vertically extending elongated slot 152 sized such that shaft 140 fits therethrough. As shown, the plates 112 are positioned/stacked such that their vertically extending elongated slots are substantially aligned. When more than one slot 152 is used, then slots 152 can be identical to and/or different from each other, whether in size, structure, area, orientation, shape, and so forth. Also note that block 130 has at least one opening 150 therethrough. Opening 150 is sized such that shaft 140 fits therethrough. When more than one opening 150 is used, then openings 150 can be identical to and/or different from each other, whether in size, structure, area, orientation, shape, and so forth. Note that block 130 at least partially conforms to shape of opening 124.

In other example embodiments, hand sanding apparatuses, as disclosed herein, can lack handles, motors, motorized plates, rotational abrasive surfaces, blades, nails, nuts, and bolts. Also note that hand sanding as used herein can be used for wood working, auto body parts, and so forth. Further note that hand sanding apparatuses as disclosed herein can be manufactured for right hand only use, left hand only use, and ambidextrous use.

While the preferred embodiment to the disclosure had been described, skilled artisans, both now and in the future, may make various improvements and/or enhancements which fall within the scope of the claims which follow. These claims should be construed to maintain the proper protection for the disclosure first described.

What is claimed is:

1. A hand sanding apparatus comprising:

a plate housing having a U-shaped top portion defined via a pair of opposing end members and a pair of opposing sidewalls spanning between said members along a sanding direction, said members having a pair of top surfaces extending along said direction and spanning between said sidewalls, said surfaces are outwardly arcuate along said direction between said sidewalls, said members and said sidewalls defining an upper opening therebetween, said housing having a pair of opposing T-shaped members, each of said T-shaped members defined via a pair of arms extending from a leg, said legs extending from said end members such that said arms face each other, said surfaces are continuous with said legs, said housing having a pair of opposing side members spanning between said arms along said direction, said side members and said T-shaped members defining a lower opening therebetween, said lower opening providing access to said upper opening, said lower opening greater in area than said upper opening, wherein one of said side members, said portion, and said T-members defining a recessed side opening extending along said direction;

a plurality of flat plates extending along said direction between said T-shaped members, said plates positioned adjacent to each other between said sidewalls and between said side members, said upper opening providing partial access to said plates such that said plates can be manually pushed through said upper opening away from said upper opening, said members partially overlaying said plates along said direction between said sidewalls to limit movement of said plates at least perpendicularly to said direction past said surfaces.

2. The apparatus of claim 1, wherein said upper opening avoids extending past said side opening along said direction on both sides of said side opening, another one of said side members is continuous with said top portion via a recessed sidewall having a first shaft opening therethrough, said recessed sidewall opposing said side opening.

3. The apparatus of claim 2, further comprising:

a shaft having a T-end, said shaft extending through said plates;

a lever coupled to said shaft distal to said T-end, said lever avoids extending past one of said sidewalls when in locked position, said one of said sidewalls is proximate to said one of said side members;

a block sized for conforming to said side opening, said block containing a second shaft opening, said shaft extending through said second shaft opening, said block is between said lever and said plates, a spring stationed along said recessed sidewall, said spring having a slot having a wider portion and a narrower portion, said T-end input into said slot via said wider portion, said T-end secured via said narrower portion, said upper opening is shorter in length along said direction than said side opening, said side opening is more recessed inward than said recessed sidewall, said arms avoid extending away from said legs past said sidewalls.

4. The apparatus of claim 3, wherein said top surfaces are outwardly arcuate diagonal to said direction.

5. The apparatus of claim 4, wherein said upper opening is U-shaped.

6. A hand sanding apparatus comprising:

a plate housing having a U-shaped top portion defined via a pair of opposing end members and a pair of opposing sidewalls spanning between said members along a sanding direction, said members having a pair of top surfaces extending along said direction and spanning between said sidewalls, said surfaces are outwardly arcuate along said direction between said sidewalls, said members and said sidewalls defining an opening therebetween, said housing having a U-shaped side portion defined via the pair of opposing end members and a base spanning between said members along said direction, said members continuously extending from said base, said base recessed with respect to one of said sidewalls, said base continuously extends from another one of said sidewalls;

a plurality of flat plates extending along said direction between said members, each plate having a vertically extending elongated slot, said plates positioned adjacent to each other between said sidewalls with their vertically extending elongated slots substantially aligned, said opening providing partial access to said plates such that said plates can be manually pushed through said opening away from said opening to vertically stagger positioning of the plates, said members partially overlaying said plates along said direction between said sidewalls to limit movement of said plates at least perpendicularly to said direction past said surfaces;

a shaft extending through the elongated slots of said plates, said shaft having a lever coupled thereto, said shaft coupled to said base distal to said lever, said lever avoids extending extending past said one of said sidewalls when in locked position.

7. The apparatus of claim 6, wherein said opening is U-shaped.

* * * * *